US006863060B2

(12) United States Patent
Martinez

(10) Patent No.: US 6,863,060 B2
(45) Date of Patent: Mar. 8, 2005

(54) PAINTBALL GUN WITH COANDA EFFECT

(76) Inventor: Robert Martinez, 2110-E Walsh Ave., Santa Clara, CA (US) 95050

( * ) Notice: Subject to any disclaimer, the term of this patent is extended or adjusted under 35 U.S.C. 154(b) by 0 days.

(21) Appl. No.: 10/695,859

(22) Filed: Oct. 30, 2003

(65) Prior Publication Data

US 2004/0089281 A1 May 13, 2004

Related U.S. Application Data

(60) Provisional application No. 60/424,003, filed on Nov. 6, 2002.

(51) Int. Cl.[7] ..... F41B 11/00
(52) U.S. Cl. ..... 124/73; 124/56
(58) Field of Search ..... 124/73, 71, 56

(56) References Cited

U.S. PATENT DOCUMENTS

| | | | |
|---|---|---|---|
| 2,052,869 | A | 9/1936 | Coanda |
| 3,774,847 | A | 11/1973 | Malec |
| 3,795,367 | A | 3/1974 | Mocarski |
| 3,806,039 | A | 4/1974 | Mocarski |
| 4,024,790 | A | 5/1977 | Heiderer |
| 4,046,492 | A | 9/1977 | Inglis |
| 4,055,870 | A | 11/1977 | Furutsutsumi |
| 4,174,071 | A | 11/1979 | Lau et al. |
| 4,192,461 | A | 3/1980 | Arborg |
| 4,336,017 | A | 6/1982 | Desty |
| 4,448,354 | A | 5/1984 | Reznick et al. |
| 4,634,050 | A | 1/1987 | Shippee |
| 4,702,420 | A | 10/1987 | Rath |
| 5,135,167 | A | 8/1992 | Ringer |
| 5,228,427 | A | 7/1993 | Gardiner, Jr. |
| 5,245,905 | A | 9/1993 | Bundy |
| 5,402,938 | A | 4/1995 | Sweeney |
| 5,525,510 | A | 6/1996 | McCabe et al. |
| 5,640,945 | A | 6/1997 | Slonaker et al. |
| 5,967,133 | A | 10/1999 | Gardiner, Jr. |
| 6,003,504 | A | 12/1999 | Rice et al. |
| 6,062,208 | A | 5/2000 | Seefeldt et al. |
| 6,065,460 | A | 5/2000 | Lotuaco, III |
| 6,213,111 | B1 | 4/2001 | Alexander et al. |
| 6,227,187 | B1 | 5/2001 | Alexander et al. |
| 6,299,804 | B1 | 10/2001 | Domodossola et al. |
| D451,977 | S | 12/2001 | Urbano |
| 6,343,599 | B1 | 2/2002 | Perrone |
| 6,349,711 | B1 | 2/2002 | Perry et al. |

*Primary Examiner*—Teri P. Luu
*Assistant Examiner*—Jordan Lofdahl
(74) *Attorney, Agent, or Firm*—Richard C. Litman

(57) ABSTRACT

A paintball gun utilizing the Coanda effect in firing and/or loading paintballs. A Coanda chamber located in the bolt, feed tube, or barrel propels, loads, or spins a paintball. The Coanda chambers, which can be used in any combination include a port for receiving air, an inner cell, an outer cell and an annular ring defining a passageway between the cells. The chamber located in the bolt for propelling the ball includes walls in the outer cell. The air follows the sloped walls and hits the ball at its periphery, eliminating distortion and breakage of the ball. The chamber located in the feed tube forces the ball into the barrel and creates a vacuum to eliminate the ball blowing back up the feed tube. The annular ring in the chamber in the barrel is partially blocked, directing the air to put a spin on the ball.

9 Claims, 3 Drawing Sheets

PAINTBALL GUN WITH COANDA EFFECT

CROSS-REFERENCE TO RELATED APPLICATION

This application claims the benefit of U.S. Provisional Patent Application Ser. No. 60/424,003, filed Nov. 6, 2002.

BACKGROUND OF THE INVENTION

1. Field of the Invention

The present invention relates generally to guns. More specifically, the present invention is a bolt, feed tube, and barrel mechanism based on the Coanda effect for paintball guns.

2. Description of Related Art

The art of interest describes various structures using the Coanda effect but none discloses the present invention. The prior art fails to disclose structure for firing paintballs without distortion to the paintball itself.

U.S. Patent Publication No. US 2001/0,042,543 A1 published on Nov. 22, 2001, for Aldo Perrone describes an electrically operated paintball device which includes a feed tube above the breech, but fails to indicate the feed tube stores paintballs and any Coanda effect structure. A paintball is propelled by pressured carbon dioxide gas. The gun is distinguishable for lacking paintball storage on the gun and any Coanda effect structure.

U.S. Pat. No. 2,052,869 issued on Sep. 1, 1936, to Henri Coanda describes two nozzle devices for deflecting a fast stream of gas projected from a nozzle into another static gas. The first nozzle in FIG. 2 adds a planar flap on one side of the nozzle slot. The second nozzle in FIG. 3 has increased the bulk and extension of only one side of the slot to cause the effluent gas to suck the ambient gas around the curved extension to reverse the flow of both gases. These devices are basic nozzle configurations adopted by the several subsequent patents discussed.

U.S. Pat. No. 3,774,847 issued on Nov. 27, 1973 to Jerry Malec teaches an aspirator nozzle for blow guns which utilizes the Coanda effect. The Malec structure is distinguishable in that it is not a paintball gun.

U.S. Pat. No. 3,795,367 issued on Mar. 5, 1974, to Zenon R. Mocarski describes a first nozzle device using the Coanda effect by which a primary small volume of high velocity fluid induces flow of a secondary fluid with the exhaust fluid being a combination of both fluids assumed to be gasoline added to air in a carburetor. A second embodiment employs a slit in the upper front section of a wing to provide a slit. The nozzle device is distinguishable for being limited to combining two gases, wherein one gas is volatile, and does not suggest the present invention of propelling an object.

U.S. Pat. No. 3,806,039 issued on Apr. 23, 1974, to Zenon R. Mocarski describes a Coanda type nozzle of an air gun with a discontinuous slot in a through passageway to induce the flow of ambient air at the entrance of the passageway so that the nozzle discharge is a combination of both the pressurized air and the ambient air. The nozzle is distinguishable for using the Coanda effect as a fluid amplifier as opposed to the firing and feeding of the paintballs.

U.S. Pat. No. 4,024,790 issued on May 24, 1977, to Conrad E. Heiderer describes a bore gas evacuation device for cannons and guns using the Coanda effect to enhance the flow of ambient air through the barrel into the Coanda slot during firing and exhausting or aspirating the bore after firing to exhaust the bore of exhaust gases. The Coanda effect is effected by a narrow space or slot between the end of the receiver portion and the end wall of the breech portion. Pressurized air at port 44 is also utilized. The Coanda effect is being used here to accumulate the pressurized air in the annular gas accumulator chamber surrounding the slot to exhaust the combustion fumes from the muzzle. This application of the Coanda effect bears no resemblance to that employed in the present invention to propel the paintball out of the gun barrel.

U.S. Pat. No. 4,336,017 issued on Jun. 22, 1982, to Denis H. Desty describes a flare device with inwardly directed Coanda nozzle for disposal of combustible gases using high pressure steam. The nozzle has a self-adjusting slot and a low pressure fuel gas supply is entrained in the nozzle mouth. The flare device is distinguishable for applying the Coanda effect to a non-analogous art.

U.S. Pat. No. 4,448,354 issued on May 15, 1984, to Steven G. Reznick et al. describes an axisymmetric thrust augmenting ejector with discrete primary air slot nozzles for improving the effectiveness of thrust generation for vectored thrust vertical takeoff and landing aircraft and short takeoff and landing aircraft. The ejectors are distinguishable for being limited to aircraft.

U.S. Pat. No. 4,702,420 issued on Oct. 27, 1987 to Anton Rath teaches a spray gun for coating material which utilizes the Coanda effect. The Rath structure is distinguishable in that it is not a paintball gun.

U.S. Pat. No. 5,402,938 issued on Apr. 4, 1995, to Ray O. Sweeney describes an air amplifier device with an improved operating range using a tapered shim for use in pneumatic control systems that can operate over a wide range of flow and pressure characteristics and against back pressure. The tapered ring-shaped shim causes the pressurized air to follow a Coanda profile over a wider range. The shim has inwardly directed tangs that are cut off to provide an open central area. Some or all of the tangs are tapered along either one or both sides. The air amplifier device is distinguishable applying the Coanda effect to a non-analogous art.

U.S. Pat. No. 5,525,510 issued on Jun. 11, 1996, to Dennis E. McCabe et al. describes a Coanda effect gene delivery instrument apparatus, wherein a gaseous stream of carrier particles coated with foreign genes on a carrier ribbon are displaced and accelerated toward an exit port by a high pressure stream of helium. Proximate the exit port, the gaseous stream is diverted by the Coanda effect away from a target area, the heavier carrier particles continue on and toward the target cells which are recovered, wherein some target cells contain the foreign gene in their genome. The apparatus is distinguishable for being structurally and functionally different from a gun in separating heavier particles from an air stream.

U.S. Pat. No. 5,640,945 issued on Jun. 24, 1997, to Robert M. Slonaker et al. describes a paintball and paintball gun having a vertical magazine positioned on top of the barrel in front of the trigger. The paintball is fed by gravity into the barrel one at a time in front of a narrow passageway from which compressed gas is released to propel the paintball out. The gun has a pistol grip and transverse arcuate recesses in the barrel to cause backspin of the paintball. The gun is distinguishable for failing to show any Coanda effect in its operation.

U.S. Pat. No. 6,003,504 issued on Dec. 21, 1999, to John R. Rice et al. describes a paintball gun having two gas pressure regulators. The first regulator maintains a high gas pressure in a first chamber in the gun, and the second regulator is connected between the first and second chambers in the gun to maintain a working gas pressure in the second chamber between atmospheric pressure and the first regulator's high gas pressure. There is no Coanda effect involved. The gun is distinguished by the lack of a Coanda effect being utilized.

U.S. Pat. No. 6,065,460 issued on May 23, 2000, to Nicanor D. Lotuaco, III describes a dual-pressure electronic paintball gun having a ball feed port for a hopper (not illustrated) containing a plurality of paintballs on the top of the breech. The gun is distinguishable for lacking structure in the gun utilizing the Coanda effect to increase the air pressure for propelling the paintball.

U.S. Pat. No. 6,213,111 B1 issued on Apr. 10, 2001, and U.S. Pat. No. 6,227,187 B1 issued on May 8, 2001, to Aaron K. Alexander et al. describe an air holding chamber in front for air-powered paintball guns which increases the air volume stored inside the gun and allows the use of a low-pressure/high volume valve in the gun. The apparatus is distinguishable for failing to utilize the Coanda effect for loading paintballs.

U.S. Pat. No. 6,299,804 B1 issued on Oct. 9, 2001, to Robert Domodossola et al. describes an air cooling system for preform molding which has a structure having a barrel like tube open at both ends, and incorporates an internal curved gap through which compressed air is supplied. The system is distinguishable for requiring compressed air for functioning as an air cooling system.

Paintball guns or other devices for propelling by using compressed air are taught in U.S. Pat. No. 4,046,492, issued on Sep. 6, 1977 to Leslie Inglis, U.S. Pat. No. 4,055,870, issued on Nov. 1, 1977 to Yasuzi Furutsutsumi, U.S. Pat. No. 4,174,071, issued on Nov. 13, 1979 to George Lau et al., U.S. Pat. No. 4,192,461, issued on Mar. 11, 1980 to Ole Arborg, U.S. Pat. No. 4,634,050, issued on Jan. 6, 1987 to James Shippee, U.S. Pat. No. 5,135,167, issued on Aug. 4, 1992 to Thomas Ringer, U.S. Pat. No. 5,228,427, issued on Jul. 20, 1993 to William Gardiner, Jr., U.S. Pat. No. 5,245,905, issued on Sep. 21, 1993 to Mark Bundy, U.S. Pat. No. 5,967,133, issued on Oct. 19, 1999 to William Gardiner, Jr., U.S. Pat. No. 6,062,208, issued on May 16, 2000 to William Seefeldt et al., U.S. Pat. No. 6,343,599, issued on Feb. 5, 2002 to Aldo Perrone, and U.S. Pat. No. 6,349,711, issued on Feb. 26, 2002 to Rod Perry et al. However, none of these patents teach the instant structure including the paintball gun and Coanda chamber.

U.S. Des. Pat. No. D451,977 issued on Dec. 11, 2001, to Anthony P. Urbano describes a ball and air chamber for a paintball gun having an apertured over and under double barrel with a pressurized propellant tank attached to the handle bottom and to the lower barrel. The gun is distinguishable for its double barrel and the lack of using a Coanda effect delivery system.

None of the above inventions and patents, taken either singly or in combination, is seen to describe the instant invention as claimed.

SUMMARY OF THE INVENTION

The present invention is directed to air or gas powered paintball guns utilizing the Coanda effect for firing and loading paintballs. The paintball gun uses a Coanda chamber in one or more of the bolt, the feed tube for assisting in loading the paintballs, and the barrel for applying backspin on the paintball.

Accordingly, it is a principal object of the invention to provide at least one Coanda chamber to a paintball gun to propel, load, or apply backspin to paintballs.

It is an object of the invention to provide improved elements and arrangements thereof in an apparatus for the purposes described which is dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
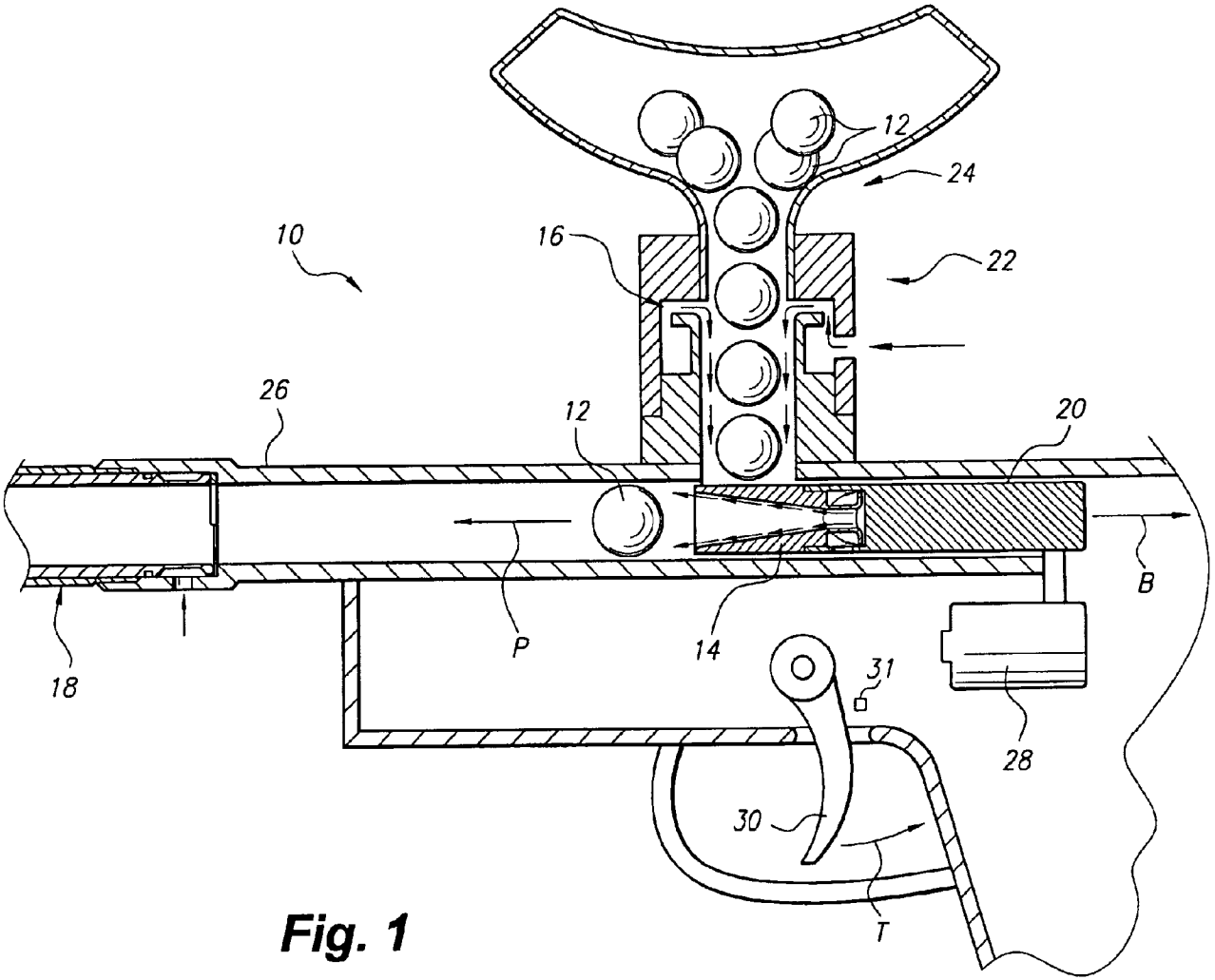
FIG. 1 is a schematic cross-sectional view of a paintball gun having Coanda chambers in the bolt, feed tube, and barrel according to the present invention.

The present invention is schematically presented on an exemplary structure illustrated in cross-section in FIG. 1 as a paintball gun 10 propelling a paintball 12. The gun 10 shown in FIG. 1 utilizes the Coanda chambers 14, 16, and 18 to propel, load, and apply backspin to a paintball 12. It is to be understood that the present invention contemplates that the Coanda chambers 14, 16, and 18 may be present in any combination, i.e. all three chambers, any two. chambers, or any one chamber may be used. This choice will depend on the properties desired to be imparted to the paintball gun. The Coanda chambers 14, 16, and 18 are located in the front portion of the bolt 20, in the feed tube portion 22 of the hopper assembly 24, and in the barrel 26, respectively.

It is noted that the hopper assembly 24 is shown as being located on top of the barrel 26. However, the present invention contemplates the location anywhere along the barrel and at any orientation. The unique way of feeding the balls 12 (as discussed below) can overcome forces due to gravity and allows the hopper to be located below the barrel.

As the bolt 20 and hammer 28 combination is pushed rearwardly by air from a pneumatic valve (not shown), the Coanda chamber 16 is charged and a paintball 12 is forced into the barrel 26 by the vacuum created in the Coanda chamber 16. Further, the vacuum prevents the balls 12 from being blown back up the feed neck.

The ball 12 is then propelled by pulling the trigger 30 in the direction of arrow T, resulting in contact with and activation of microswitch 31. This activation of the microswitch causes the reversal of the pneumatic valve and forces the bolt 20 and hammer 28 combination forward. The bolt 20 is seen in the forward position in FIG. 1. The released air flow travels through the Coanda chamber 14 of the bolt 20 and forces the paintball 12 out of the front of the barrel 26 in the direction of arrow P.

After the ball is fired, the pneumatic valve again forces the bolt 20 rearwardly, as indicated by arrow B. The air used to force the bolt 20 rearwardly (exhaust air from the pneumatic valve) is fed into the Coanda chamber 16 and another ball 12 is fed into the barrel 26, i.e. the gun is cocked. Hence, the activation of the microswitch by the trigger 30 brings the bolt 20 forward to fire a ball 12 in the barrel 26, then brings the bolt 20 backward, feeds the Coanda chamber 16, and loads another ball 12.

Figure 2:
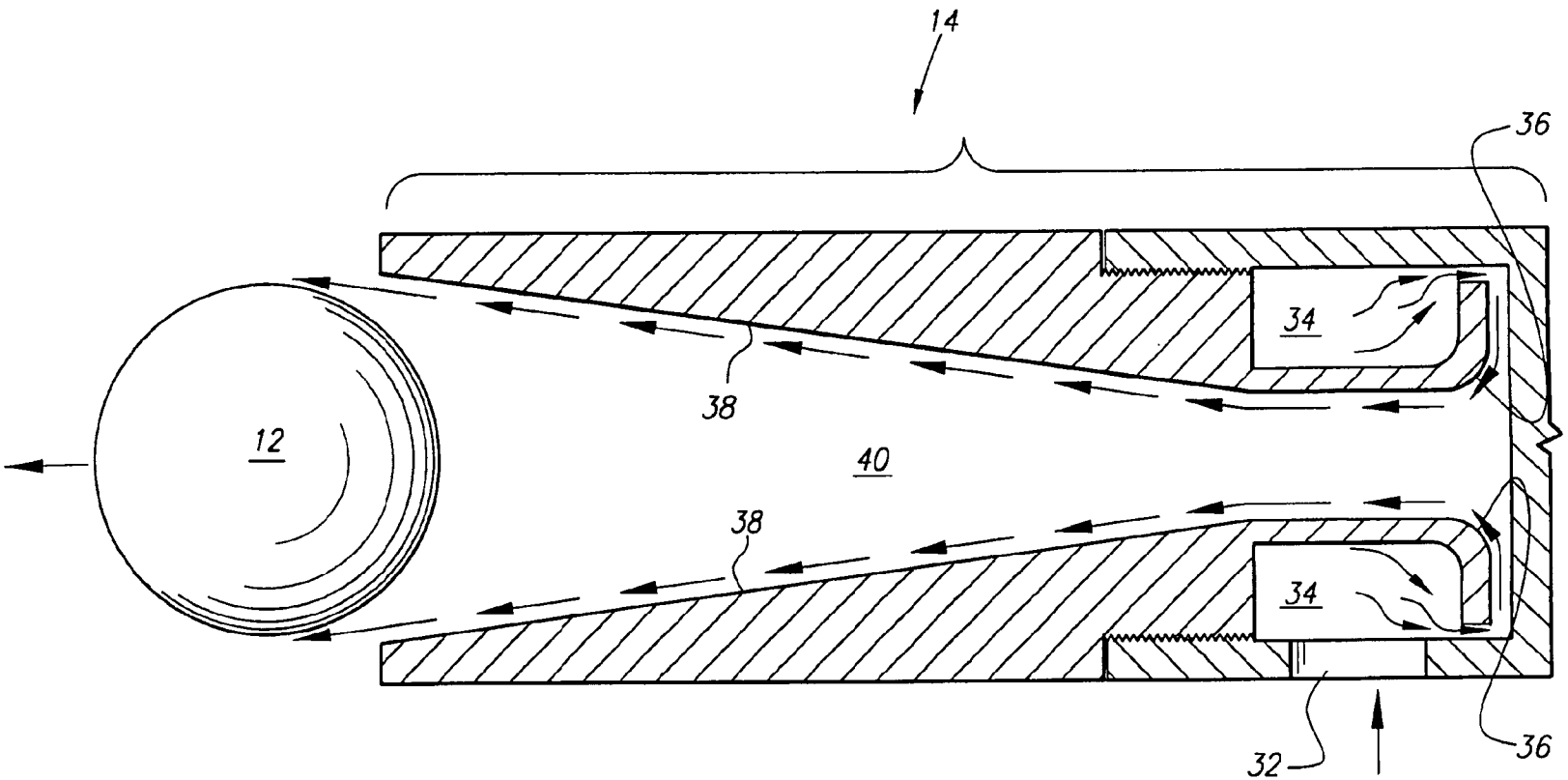
FIG. 2 is a cross-sectional detailed view of the portion of the bolt in FIG. 1 which includes the Coanda chamber.

FIG. 2 shows a more detailed view of the Coanda chamber 14 at the front portion of the bolt 20. As the gun is fired, i.e. the trigger 30 is pulled backwards, pressurized air is received into the Coanda chamber 14 through port 32 into inner cell 34. The air travels from this relatively large cell 34 through a relatively narrow passageway defined by an annular ring 36.

The air follows the contour of the annular ring 36 and the outwardly sloping walls 38 of the outer cell 40. The air stays against the walls 38 according to the physical principle known as the Coanda effect, the tendency of a fluid or air to follow the curved surfaces of a wall. Because the high pressure air is against the walls 38, the flow of air hitting the ball 12 will be mainly on the outer perimeter of the balls, eliminating distortion and breakage due to air hitting the center of the ball.

Figure 3:
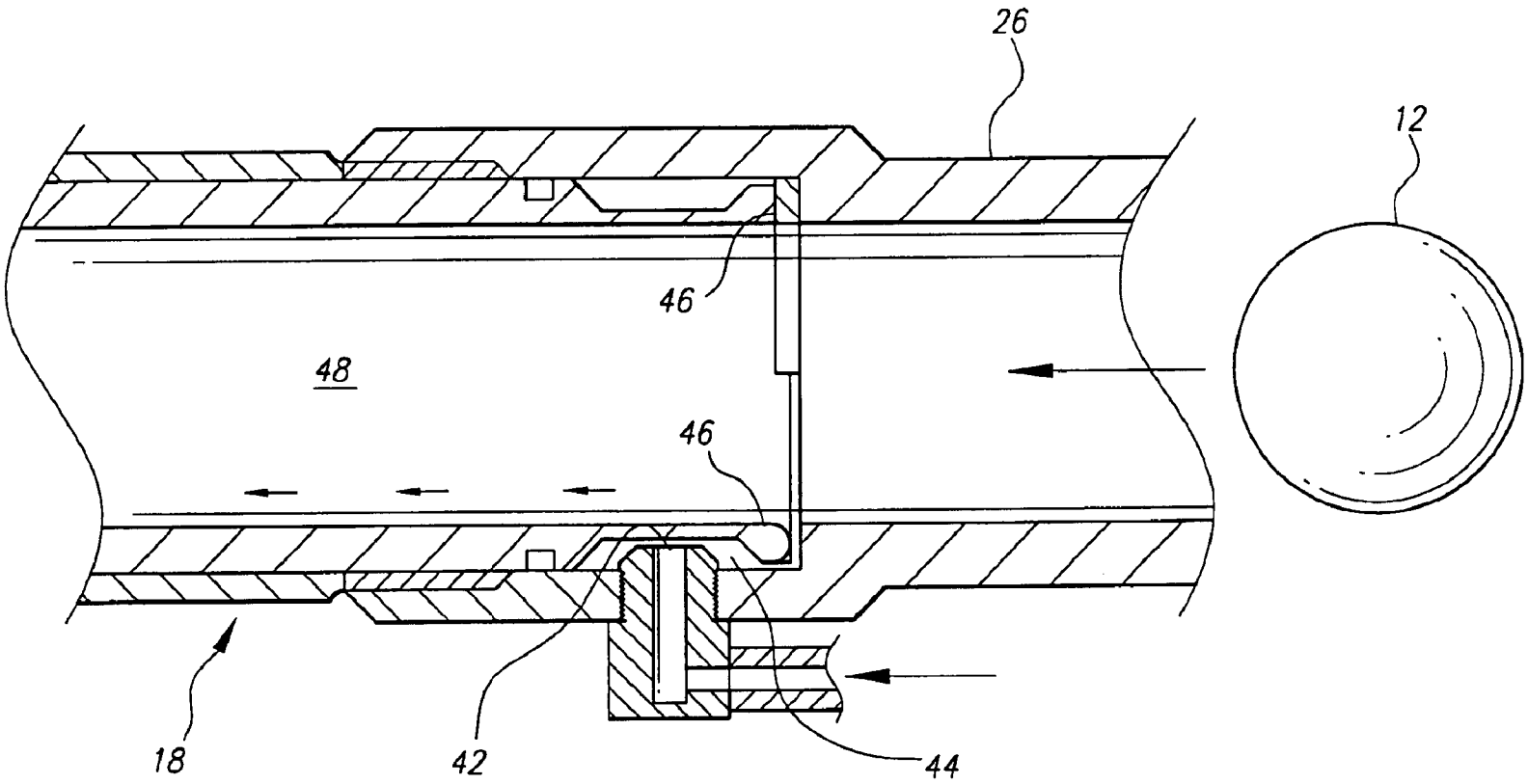
FIG. 3 is a cross-sectional detailed view of the portion of the barrel in FIG. 1 which includes the Coanda chamber.

FIG. 3 is a detailed view of the Coanda chamber 18 in the barrel 26. Air is received into the Coanda chamber 18 through port 42 into inner cell 44. The air travels from cell 44 through the passageway defined by annular ring 46. The upper half of the annular ring 46 is closed, i.e. it extends to the walls of the inner cell 44, and there is no passageway and no airflow from the upper half of the inner cell 44.

The air follows the contour of the annular ring 46 along the lower portion of the wall of the barrel 26 and into the outer cell 48. Air hits the lower portion of the ball 12 and propels it slightly faster than the upper portion, creating a backspin on the ball 12. It is noted that an opposite configuration, i.e. the lower portion of the annular ring 46 is closed, will create a topspin on the ball 12.

It is to be understood that the present invention is not limited to the sole embodiment described above, but encompasses any and all embodiments within the scope of the following claims.

I claim:

1. A device having a Coanda chamber comprising:

a paintball gun;

said Coanda chamber located in a portion of said gun and including:

a port for receiving air;

an inner cell into which the air is received through said port;

an annular ring defining a passageway for the air to flow; and an outer cell into which the air flows for urging a paintball.

2. The device of claim 1 wherein said gun includes a bolt and said chamber is located in said bolt.

3. The device of claim 2 wherein said outer cell of said chamber includes sloping walls such that the air flow is against the walls and will contact a periphery of a paint ball.

4. The device of claim 1 wherein said gun includes a feed tube and said chamber is in said feed tube.

5. The device of claim 1 wherein said chamber is in a barrel portion of said gun.

6. The device of claim 5 wherein a portion of said annular ring is blocked off so air flows in only a portion of said outer cell, whereby a spin is created on a paintball.

7. A paintball gun comprising a bolt, a barrel, and a feed tube, each of said bolt, barrel, and feed tube including a Coanda chamber for propelling, loading, or spinning a paintball, wherein each said Coanda chamber includes: a port for receiving air; an inner cell into which the air is received through said port; an annular ring defining a passageway for the air to flow; and an outer cell into which the air flows for urging a paintball.

8. The paintball gun of claim 7 wherein said outer cell of said chamber in said bolt includes sloping walls such that the air flow is against the walls and will contact a periphery of a paint ball.

9. The paintball gun of claim 7 wherein a portion of said annular ring of said chamber in said barrel is blocked off so air flows in only a portion of said outer cell, whereby a spin is created on a paintball.

* * * * *